US006840803B2

(12) United States Patent
Wlos et al.

(10) Patent No.: US 6,840,803 B2
(45) Date of Patent: Jan. 11, 2005

(54) CRIMP CONNECTOR FOR CORRUGATED CABLE

(75) Inventors: James Wlos, Crete, IL (US); James Krabec, Oak Lawn, IL (US)

(73) Assignee: Andrew Corporation, Orland Park, IL (US)

( * ) Notice: Subject to any disclaimer, the term of this patent is extended or adjusted under 35 U.S.C. 154(b) by 59 days.

(21) Appl. No.: 10/248,741

(22) Filed: Feb. 13, 2003

(65) Prior Publication Data

US 2004/0161969 A1 Aug. 19, 2004

(51) Int. Cl.[7] ..... H01R 17/04
(52) U.S. Cl. ..... 439/585; 439/578
(58) Field of Search ..... 439/585, 578–584, 439/685, 695, 932

(56) References Cited

U.S. PATENT DOCUMENTS 4,990,106 A * 2/1991 Szegda ..... 439/585
5,073,129 A 12/1991 Szegda
5,141,451 A * 8/1992 Down ..... 439/585
5,154,636 A * 10/1992 Vaccaro et al. ..... 439/583
5,281,167 A * 1/1994 Le et al. ..... 439/578
5,334,051 A 8/1994 Devine et al.
5,518,420 A * 5/1996 Pitschi ..... 439/578
5,561,900 A 10/1996 Hosler, Sr.
5,595,502 A 1/1997 Allison
5,795,188 A 8/1998 Harwath
5,802,710 A * 9/1998 Bufanda et al. ..... 29/828
5,877,452 A 3/1999 McConnell
5,938,474 A 8/1999 Nelson
5,944,556 A 8/1999 Wlos et al.
5,977,484 A * 11/1999 Jones et al. ..... 174/135
6,471,545 B1 10/2002 Hosler, Sr.
6,575,786 B1 * 6/2003 Khemakhem et al. ..... 439/580

* cited by examiner

*Primary Examiner*—Hien Vu
(74) *Attorney, Agent, or Firm*—Babcock IP, LLC

(57) ABSTRACT

A corrugated coaxial cable connector, field installable with a hand crimp tool has a connector interface coupled to the connector end of a hollow cylindrical body; an inner surface of the body is adapted to thread onto the helical corrugations on the outer conductor of the cable. A plurality of ridges on an outer surface of the body corresponding to an internal threaded section forms a crimp surface. An inner contact located coaxially within the body has a socket contact section at the cable end dimensioned for insertion of the inner conductor of the cable and electrical connection therewith. A body barb located on the outer surface of the body provides an acute surface for heat shrink tubing to seal against.

19 Claims, 5 Drawing Sheets

CRIMP CONNECTOR FOR CORRUGATED CABLE

BACKGROUND OF INVENTION

1. Field of the Invention

The invention relates to electrical cable connectors. More specifically, the invention relates to a cost efficient low loss connector suitable for field installation upon corrugated coaxial cable using common hand tools.

2. Description of Related Art

Connectors for corrugated outer conductor cable are used throughout the semi-flexible corrugated coaxial cable industry.

Competition within the cable and connector industry has increased the importance of minimizing installation time, required installation tools, and connector manufacturing/materials costs.

Previously, connectors have been designed to attach to coaxial cable using solder, and or mechanical compression. The quality of a solder connection may vary with the training and motivation of the installation personnel. Solder connections are time consuming and require specialized tools, especially during connector installation under field conditions. Mechanical compression connections may require compressive force levels and or special tooling that may not be portable or commercially practical for field installation use. Mechanical compression designs using wedging members compressed by tightening threads formed on the connector may be prohibitively expensive to manufacture.

The corrugation grooves of heliacally corrugated coaxial cable may provide a moisture infiltration path into the internal areas of the connector/cable interconnection. The infiltration path(s) may increase the chances for moisture degradation/damage to the connector, cable and or the connector/cable interconnection. Previously, o-rings or lip seals between the connector and the cable outer conductor and or sheath have been used to minimize moisture infiltration. O-rings may not fully seat/seal into the bottom of the corrugations and lip seals or o-rings sealing against the sheath may fail over time if the sheath material deforms.

Heat shrink tubing has been used to protect the connector/cable interface area and or increase the rigidity of the connector/cable interconnection. However, the heat shrink tubing may not fully seal against the connector body, increasing the moisture infiltration problems by allowing moisture to infiltrate and then pool under the heat shrink tubing against the outer conductor seal(s), if any.

Therefore, it is an object of the invention to provide a coaxial connector that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
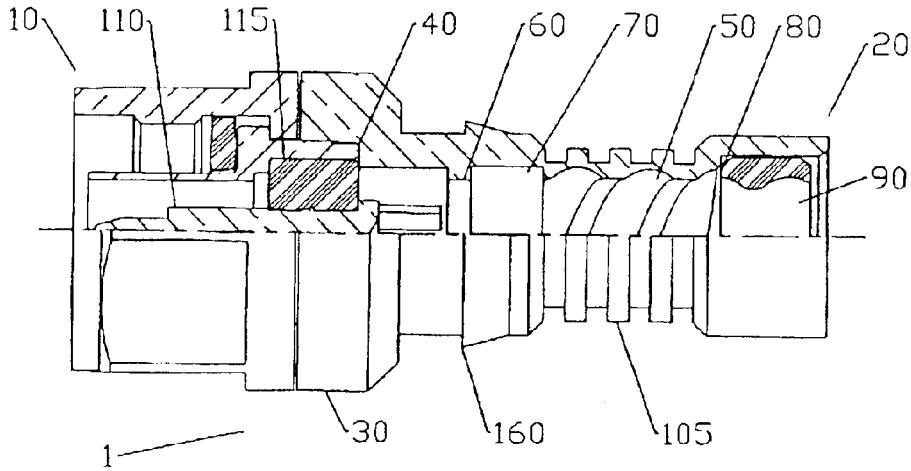
FIG. 1 shows an external side and partial section view of one embodiment of the invention.
Figure 2:
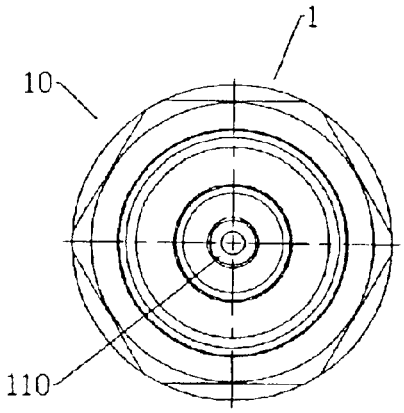
FIG. 2 shows an external connector end view of the embodiment of the invention shown in FIG. 1.
Figure 3:
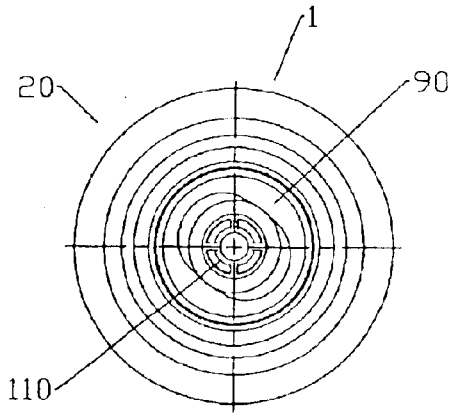
FIG. 3 shows an external cable end view of the embodiment of the invention shown in FIG. 1.

One embodiment of a crimp connector, for example a type N connector, is shown in FIG. 1. The crimp connector 1 has a connector end 10 (FIG. 2) and a cable end 20 (FIG. 3). The specific form or connector interface of connector end 10 may depend on the intended coaxial cable diameter/type and or the application the crimp connector is intended for. The connector end 10 of the crimp connector may be configured with a connector interface selected to mate with any type of connector mounted on a device/cable using, for example, standard type N, BNC, SMA, DIN, UHF, CATV, EIA, or a proprietary connector interface configuration. Dimensions/configuration of the crimp connector 1 at the connector end 10 that form the desired standardized connector type are known in the art. A connector end 10 in a type N configuration is shown in FIGS. 1 and 2.

Figure 4A:
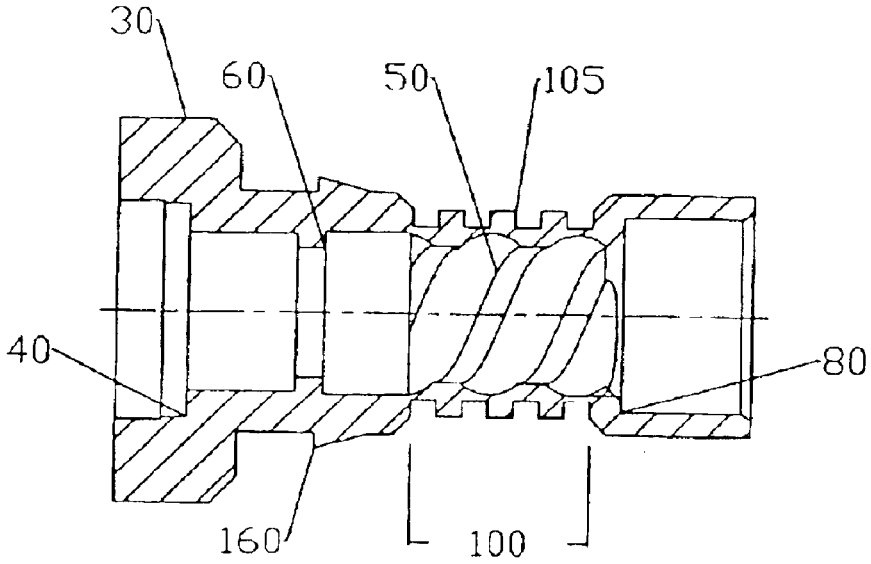
FIG. 4*a* shows a section side view of a body portion of the embodiment of the invention shown in FIG. 1.
Figure 4B:
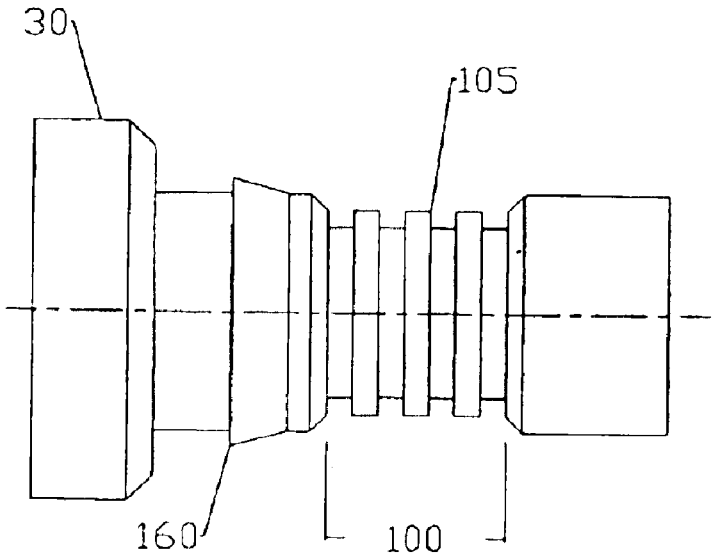
FIG. 4*b* shows an external side view of a body portion of the embodiment of the invention shown in FIG. 1.
Figure 5A:
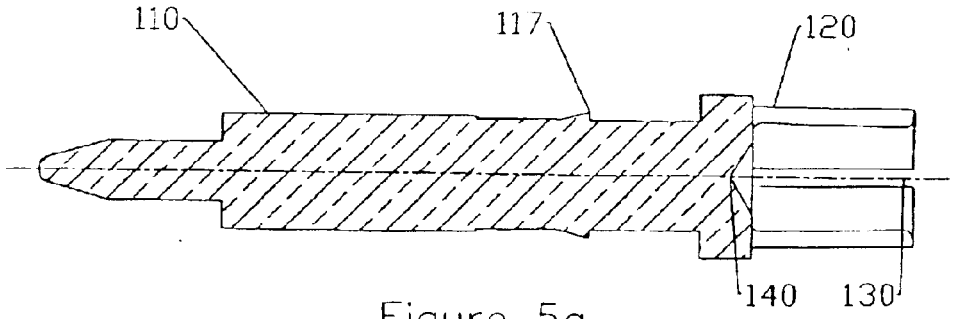
FIG. 5*a* shows a side section view of an inner contact of the embodiment of the invention shown in FIG. 1.
Figure 5B:
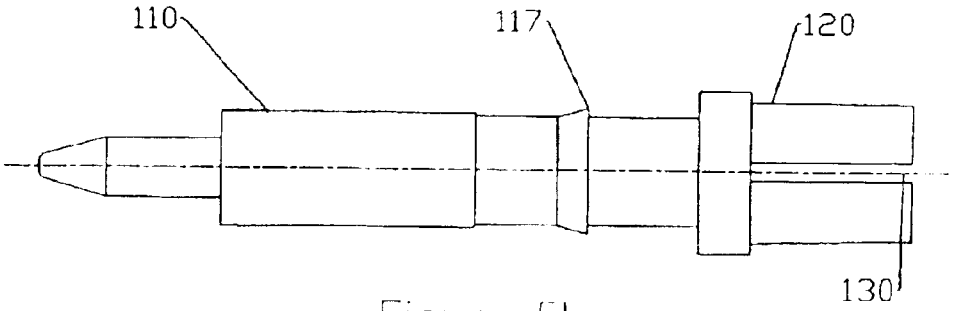
FIG. 5*b* shows an external side view of an inner contact of the embodiment of the invention shown in FIG. 1.
Figure 6:
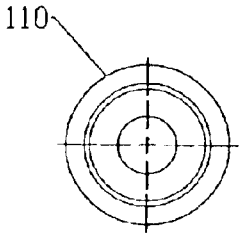
FIG. 6 shows an external connector end view of the inner contact shown in FIGS. 5*a* and 5*b*.

As shown in FIGS. 4*a* and 4*b*, a body 30 forms the outer shell of the cable end 20. The body 30 has a connector end annular shoulder 40 for receiving and retaining via, for example an interference fit, the connector end 10. A threaded section 50 is formed to mate with helical corrugations in the outer conductor of the desired coaxial cable. The body 30 may be formed from, for example brass or other metal alloy. To minimize corrosion and or dissimilar metal reactions with the connector end 10 and or the outer conductor of the cable, the body 30 may have a corrosion resistant plating, for example, tin or chromium plating.

A cable end shoulder 80 may be added to the body 30 for seating a gasket 90 or an application of sealant, described herein below.

A helically corrugated coaxial cable may be prepared for attaching the crimp connector 1 by exposing an appropriate length of the cable's inner conductor and removing any outer sheath from a section of the outer conductor. The crimp connector 1 may then be hand threaded onto the cable until the cable's outer conductor impacts upon a stop 60 that extends radially inward across the radial depth of the body 30. When the leading edge of the cable outer conductor contacts the stop 60, further threading may partially collapse/compress the cable outer conductor corrugations into a deformation groove 70.

The cable may be electrically interconnected with (outer conductor to body 30) and securely fixed within the connector 1 without requiring field application of solder or conductive adhesive by applying a crimp tool to the body 30 on a crimp area 100 which may correspond, for example, to the internal threaded section 50. The outer diameter of the crimp area 100 may be adjusted to mate with, for example, industry standard hexagonal crimp hand tools by adjusting the radius of the crimp area 100. A plurality of ridges 105 may be formed in the crimp area 100. The depth and width of grooves between the ridges 105 may be selected to adjust the compressive force, for example to be within the range of force generatable by a hand tool, required to compress/deform the internal threaded section 50 and outer conductor of the cable during the crimp operation and also to create a corresponding retentive strength of the compressed material once crimped.

Figure 7:
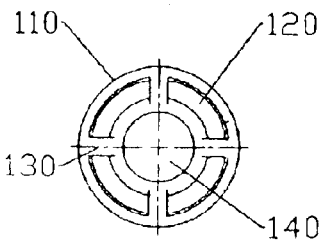
FIG. 7 shows an external cable end view of the inner contact shown in FIGS. 5*a* and 5*b*.

During the threading of the connector 1 onto the helical corrugations in the outer conductor of the cable, the cable's inner conductor is inserted into an inner contact 110 (FIGS. 5*a*–7). The inner contact 110 extends between the connector end 10 (FIG. 6) and the cable end 20 (FIG. 7). An insulator 115 may be mounted in the connector end 10 to locate the inner contact 110 coaxially spaced away from the body 30. A radial barb 117 or other structure on the inner contact 110 may be used to retain the inner contact 110 within the insulator 115.

A socket contact section 120 on the cable end 20 of the inner contact 110 may be formed with a cable end 20 diameter smaller than an outer diameter of the cable inner conductor. A plurality of slits 130 may be formed in the socket contact section 120 to allow the socket contact section 120 to easily flex and accommodate the cable inner conductor upon insertion, creating a secure electrical connection without requiring, for example, soldering or conductive adhesive. The inner contact 110 may be formed from a spring temper material, for example beryllium copper, phosphor bronze or other metal or metal alloy with suitable spring/flex characteristics. The inner contact 110 may be given a low contact resistance surface treatment, for example, gold or silver plating to increase conductive characteristics and negate dissimilar metal reactions with the center conductor of the cable and or other connectors. The appropriate length of exposed cable inner conductor, mentioned above, may be a length that results in the inner conductor being inserted into the socket contact section 120 short of contacting a depression 140 when the outer conductor of the cable has fully seated against the stop 60 and any compression of the outer conductor into the deformation groove 70 is completed.

The threaded section 50 of the embodiment shown in FIGS. 1–9 matches a cable with double helical corrugation as described in U.S. patent application Ser. No. 10/131,747 filed Apr. 24, 2002 also assigned to Andrew Corporation and hereby incorporated by reference in its entirety. The double helical corrugation provides the cable with advantageous strength, flexibility and weight characteristics. However, dual grooves that form the double helical corrugation also increase the opportunity for moisture infiltration due to the presence of an additional groove, compared to a traditional (single) helical corrugation.

Figure 8A:
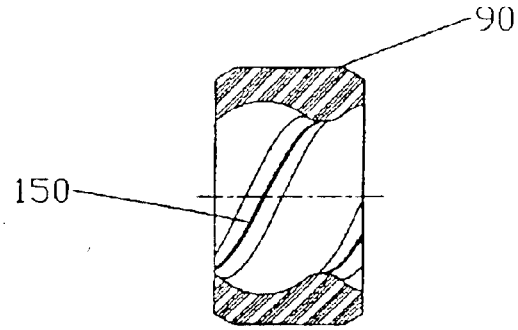
FIG. 8*a* shows a cross section view of a gasket of the embodiment of the invention shown in FIG. 1.
Figure 8B:
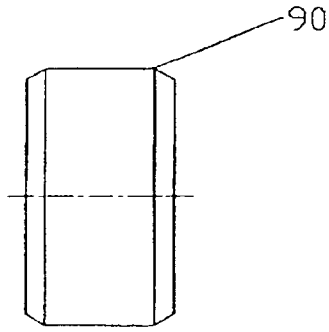
FIG. 8*b* shows an external side view of a gasket of the embodiment of the invention shown in FIG. 1.
Figure 9:
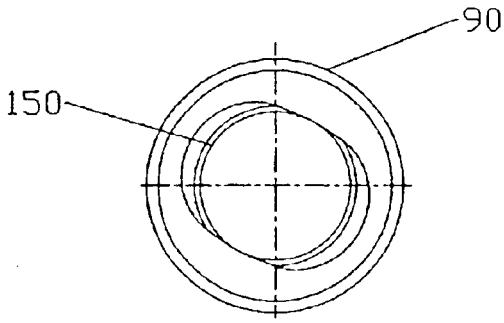
FIG. 9 shows an external cable end view of the gasket shown in FIGS. 8*a* and 8*b*.

As shown in FIGS. 8*a*–9, the gasket 90 may be prepositioned on the cable outer conductor to be located against the cable end shoulder 80 to form a seal between the body 30 and the outer conductor of the cable as the crimp connector 1 is threaded onto the cable. A pair of threads 150, one oriented for each groove, ensures that the gasket 90 fully seals against the surface of the outer conductor, to the bottom of each groove. The gasket 90 may be formed from an elastomer, for example, neoprene, EPDM, silicone or nitrile material. Alternatively, the gasket 90 may be replaced with an application of, for example, silicone or other sealant applied to the cable end shoulder and or the corresponding location on the cable outer conductor.

Figure 10:
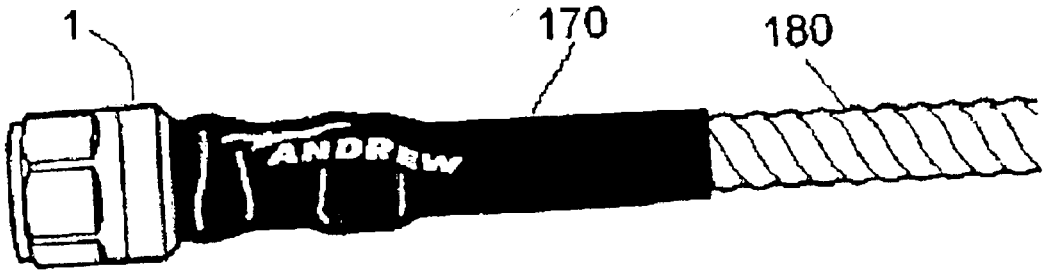
FIG. 10 shows an external side view of a connector according to one embodiment of the invention attached to a cable with heat shrink tubing applied to cover the interface between the cable and the connector.

As shown in FIG. 10, heat shrink tubing 170 may be applied over the body 30 and cable 180 interface as an additional environmental seal and to improve rigidity of the connection between the crimp connector 1 and the cable. The extended section of heat shrink tubing 170 covering the cable 180 creates an extended path through which moisture must pass to infiltrate the interconnection between the body 30 and the cable 180. However, the section of tubing over the body 30 is relatively short, creating an increased opportunity for moisture infiltration. To reduce this opportunity, an outward facing radial body barb 160 may be formed on the body 30. When the heat shrink tubing is shrunk into place upon the body 30, the body barb 160 presents an acute contact surface that the heat shrink tubing will tightly seal against/around thereby reducing the opportunity for moisture infiltration and increasing the overall rigidity of the assembly.

As described, the crimp connector provides the following advantages. The crimp connector has a limited number of components and may be cost effectively assembled with only a few manufacturing operations. Further, the crimp connector may be installed in the field, without requiring soldering or conductive adhesives, using only industry standard hand tools. Also, the crimp connector may be used with double helical corrugated cable to form a cable/connector interconnection with a high level of moisture infiltration resistance. When heat shrink tubing is applied to the crimp connector, an improved seal is created and the cable/connector interconnection has increased rigidity.

Table of Parts

| | |
|---|---|
| 1 | crimp connector |
| 10 | connector end |
| 20 | cable end |
| 30 | body |
| 40 | connector end shoulder |
| 50 | threaded section |
| 60 | stop |
| 70 | deformation groove |
| 80 | cable end shoulder |
| 90 | gasket |
| 100 | crimp area |
| 105 | ridge |
| 110 | inner contact |
| 115 | insulator |
| 117 | inner contact section |
| 120 | socket contact section |
| 130 | slits |
| 140 | depression |
| 150 | thread |
| 160 | body barb |
| 170 | heat shrink tubing |
| 180 | cable |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A connector for coaxial cable having a helically corrugated outer conductor and an inner conductor, comprising:

a connector interface at a connector end side of the connector, coupled to a hollow cylindrical body with an inner surface having an internal threaded section at a cable end side of the connector and a stop in the hollow cylindrical body proximate the connector end side of the internal threaded section which extends radially inward a deformation groove between the stop and the internal threaded section;

the internal threaded section and the stop configured to mate with the helically corrugated outer conductor, whereby the body is threadable onto the outer conductor until the outer conductor contacts the stop, the body having a plurality of ridges on an outer surface of the body corresponding to the internal threaded section; and an inner contact located coaxially within the body, the inner contact having a socket contact section at the cable end, dimensioned for insertion of the inner conductor and electrical connection therewith.

2. The connector of claim 1, further including a cable end shoulder between the threaded section and the cable end.

3. The connector of claim 2, further including a gasket, located in the cable end shoulder.

4. The connector of claim 3, wherein the gasket has an internal surface configured to mate with the helical corrugations of the outer conductor.

5. The connector of claim 3, wherein the gasket is one of neoprene, EPDM, silicone and nitrile material.

6. The connector of claim 1, wherein the socket contact section has a radius that decreases towards the cable end.

7. The connector of claim 1, wherein the socket contact section has a plurality of slits.

8. The connector of claim 1, wherein the ridges have a height and a width whereby the threaded section is crimpable by a crimping force generatable by a hand operated crimping tool.

9. The connector of claim 1, further including a retaining barb located on the outer surface at the connector end side of the plurality of ridges.

10. The connector of claim 9, wherein the retaining barb has an acute angle.

11. The connector of claim 1, wherein the connector interface is one of a type N, BNC, SMA, DIN, UHF, CATV, and EIA.

12. The connector of claim 1, wherein the connector interface is coupled to the body by an interference fit into a connector end shoulder in the connector end of the body.

13. A connector for coaxial cable having a helically corrugated outer conductor and an inner conductor, comprising:

a connector interface, coupled to a connector end side of a hollow cylindrical body; an inner surface of the body having a cable end shoulder at a cable end side, which is forward of an internal threaded section which is forward of a stop in the hallow cylindrical body proximate the connector end side which extends radially inward; the internal threaded section and the stop configured to mate with the helically corrugated outer conductor, whereby the body is threadable onto the outer conductor until the outer conductor contacts the stop a deformation groove between the stop and the internal threaded section;

a plurality of ridges on an outer surface of the body corresponding to the internal threaded section;

a body barb located on the outer surface of the body at the connector end side of the plurality of ridges; the body barb radially protruding from the body; and an inner contact located coaxially within the body, the inner contact having a socket contact section at the cable end side, dimensioned for insertion of the inner conductor and electrical connection therewith.

14. The connector of claim 13, further including a gasket located in the cable end shoulder; the gasket having an internal surface configured to mate with the helical corrugations of the outer conductor.

15. The connector of claim 13, wherein the connector interface is one of a type N, BNC, SMA, DIN, UHF, CATV, and EIA.

16. The connector of claim 13, wherein the body barb has a triangular section.

17. The connector of claim 16, further including a portion of heat shrink tubing; the heat shrink tubing applied shrunk about the body, over the body barb.

18. The connector of claim 13, wherein the body is one of aluminum, brass and bronze.

19. The connector of claim 13, wherein the inner contact is one of beryllium copper, bronze, phosphor bronze and brass.

* * * * *